United States Patent [19]

Snyder

[11] 4,212,109

[45] Jul. 15, 1980

[54] WINDAGE AND ELEVATION MECHANISM FOR LASER AIMED WEAPONS

[76] Inventor: Wesley L. Snyder, 1103 Forest Home Dr., Houston, Tex. 77077

[21] Appl. No.: 955,890

[22] Filed: Oct. 30, 1978

[51] Int. Cl.[2] ..... F41G 1/34

[52] U.S. Cl. ..... 33/241; 33/248; 33/DIG. 21; 42/1 A; 362/110

[58] Field of Search ..... 33/241, 246, 248, 257, 33/263, 286, 299, DIG. 21; 42/1 A, 1 S; 362/110, 111, 114, 390, 419, 430

[56] References Cited

U.S. PATENT DOCUMENTS

| | | | |
|---|---|---|---|
| 2,491,431 | 12/1949 | Unertl et al. | 33/248 |
| 3,635,565 | 1/1972 | Colson | 33/DIG. 21 |
| 3,867,764 | 2/1975 | Dunmire et al. | 33/241 |
| 4,026,054 | 5/1977 | Snyder | 362/110 |
| 4,152,754 | 5/1979 | de Filippis et al. | 42/1 A |

FOREIGN PATENT DOCUMENTS

| | | | |
|---|---|---|---|
| 507008 | 9/1920 | France | 362/110 |

*Primary Examiner*—Richard R. Stearns
*Attorney, Agent, or Firm*—Arnold, White & Durkee

[57] ABSTRACT

A windage and elevation mechanism is disclosed for use on a laser aimed weapon. A laser device may be enclosed in a dust proof housing and controlled by an axial shaft rigidly connected to the housing and further movably connected to an adjusting mechanism as a bearing for example. The bearing is located in a support member in conjunction with an angle bracket and spring cam operated on by a return coil spring. The support member has a plurality of apertures for accepting windage and elevation adjusting screws and the axial shaft extending from the laser housing. Upon adjustment of these windage and elevation screws the axial shaft is calibrated in a vertical and horizontal direction thus aiming the laser along the boresight of the weapon.

17 Claims, 3 Drawing Figures

WINDAGE AND ELEVATION MECHANISM FOR LASER AIMED WEAPONS

BACKGROUND OF THE INVENTION

This invention relates to laser aimed weapons in general and more specifically relates to a windage and elevation mechanism for a weapon having a laser aiming device.

Both telescopic and laser aiming devices require adjustment in both the vertical and horizontal directions with respect to the bore of the weapon. The conventional means for making these adjustments in both telescopic and laser aiming devices is through the use of set screws in conjunction with a pivoting mechanism. Since the telescopic devices are optical in nature and it is necessary for the user to view the target, the windage and elevation mechanism by necessity must be either internal to the telescopic device or external and located so as not to interfere with the optics of the device.

The use of a laser on a weapon for purposes of aiming the weapon does not require the use of conventional sights. Therefore, the weapon need not be fired at eye level but may be fired from the hip, for example.

The laser element may be disposed in a dust proof housing which is attached to the weapon and activated before firing. Such a device is disclosed in co-pending application Ser. No. 846,691 filed Oct. 31, 1977, now U.S. Pat. No. 4,161,076, entitled "Improved Laser Aiming Device For Fire Arms", by the present inventor. It is further disclosed in the above-identified patent to attach the housing carrying the laser to the weapon by use of a mounting apparatus that includes windage and elevation provisions. The windage and elevation provisions therein described adjust the vertical and horizontal movement of the laser by pivoting a flat piece of steel having a lower base portion which is bent back upon itself and twisted approximately 90° to form a vertical upper rail portion. Using a screw threaded through a hole in the lower base portion and a screw having one end engaging the rail portion the elevation of the laser is adjusted. A similar arrangement is provided for rotating a pivot screw to alter the horizontal alignment of the laser.

Conventional windage and elevation mechanisms can be found in other laser aiming systems for weapons, as for example, U.S. Pat. No. 4,026,054, by the inventor of the present invention entitled "Laser Aiming System For Weapons" and in U.S. Pat. No. 3,867,764 by Dunmire entitled "Aiming Light And Aiming Light Adapter For Use On A Weapon".

Thus, as illustrated in the laser aiming systems described above the windage and elevation mechanisms used have been consistent with the conventional windage and elevation mechanisms utilized for telescopic sighting. This manner of windage and elevation adjusting, although suitable for laser aiming devices, does not take advantage of being able to utilize any part of the member carrying the laser, including the member's rear plate, for adjusting for windage and elevation.

SUMMARY OF THE INVENTION

In accordance with the present invention a windage and elevation mechanism is provided that takes advantage of the closed rear plate of a laser aiming device attached to a weapon, to facilitate vertical and horizontal adjustment. The windage and elevation mechanism includes a support member that is attached to the weapon rearward of the laser aiming device, which may be above, below, or on either side of the barrel of the weapon. An adjusting mechanism is disposed within the support member and may be a swivel shaft bearing. The support member receives an axial shaft that is rigidly connected to the rear plate of the member carrying the laser and movably connected to the adjusting mechanism. An outstanding feature of the present invention is the use of a swivel shaft bearing connected to an axial shaft for vertically and horizontally moving the member carrying the laser.

The windage and elevation support member provides a plurality of apertures for receiving adjusting screws operating upon the bearing for setting the vertical and horizontal level of the laser aiming device.

A further outstanding feature of the present windage and elevation mechanism includes the use of an angle bracket and spring cam for holding the bearing in place to be acted upon by the adjusting screws.

A laser aiming system is also provided in accordance with the present invention utilizing the windage and elevation mechanism described above. The laser aiming system includes a laser or coherent light source. A carrying member is provided such that a buffer is disposed between the laser and internal surface of the carrying member. The buffer accepts and defrays shock upon recoil of the weapon as fired. The laser aiming system is attached to the barrel of a weapon and prevented from any rolling motion by a rubber mount located on the forward end of the bore of the weapon. The one piece construction of the laser aiming device facilitates vertical and horizontal alignment by the rigidly connected axial shaft. A flash hider tube is also provided, and connected to the laser carrying member to hide reflections from optical and other reflective surfaces.

DETAILED DESCRIPTION OF THE DRAWINGS

Figure 1:
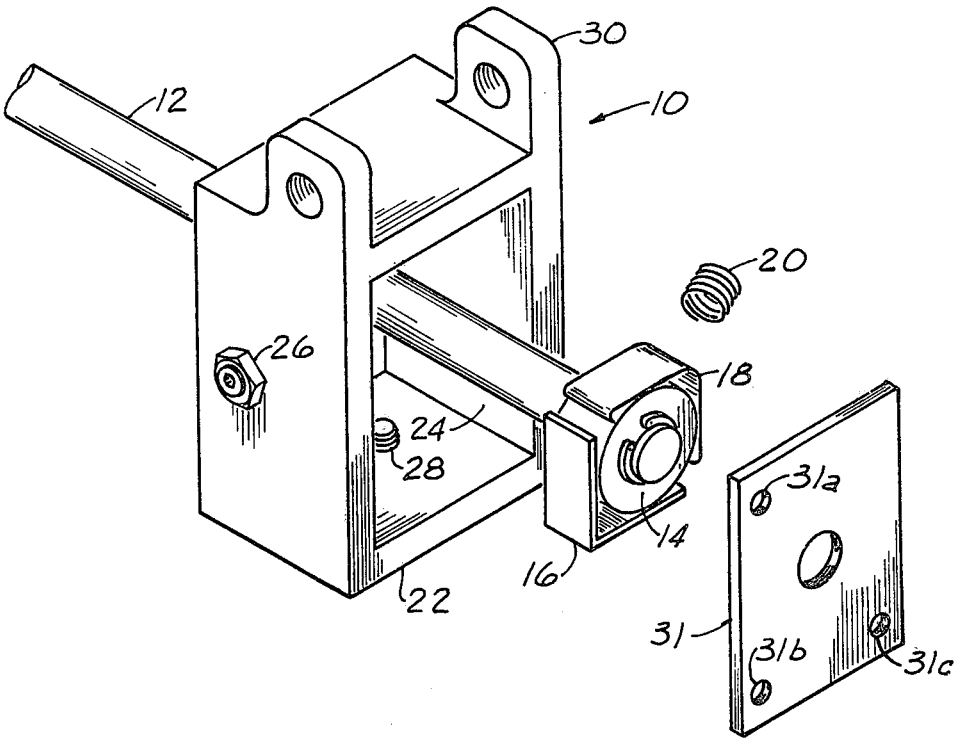
FIG. 1 is a partially exploded view of a windage and elevation mechanism in accordance with the present invention.

Referring now to the drawings and more specifically to FIG. 1, a windage and elevation mechanism 10 is generally illustrated. The windage and elevation mechanism 10 provides for vertical and horizontal movement of a laser aiming device connected to a firearm. A member 12 is attached to the laser aiming device (not shown). The member 12, shown as an axial shaft is further movably connected to an adjusting mechanism 14. The adjusting mechanism 14 is illustrated as a swivel shaft bearing, as for example a FAFNIR aircraft bearing, DSP series. An angle bracket 16 is located adjacent to the bearing 14 so as to angularly encompass a portion of the bearing. A spring cam 18 is further provided to angularly encompass the remainder of the bearing 14. The spring cam 18 is located so as to be diametrically opposed to the angle bracket 16. A spring coil 20 may also be provided to act upon the spring cam 18 for further adjusting of the bearing 14.

The bearing 14 encompassed by the angle bracket 16 and spring cam 18 and acted upon by spring coil 20 is disposed within a housing 22. The spring coil 20 is also located within the housing 22 so as to brace against the inner wall 24 in order to exert a force against the spring cam 18, thus moving the bearing 14 in a direction toward the angle bracket 16. The housing 22 is also provided with a plurality of apertures for receiving the axial shaft 12 and for receiving windage and elevation adjusting screws 26 and 28. The windage and elevation screws 26 and 28 may be of the Allen key set screw type.

Figure 3:
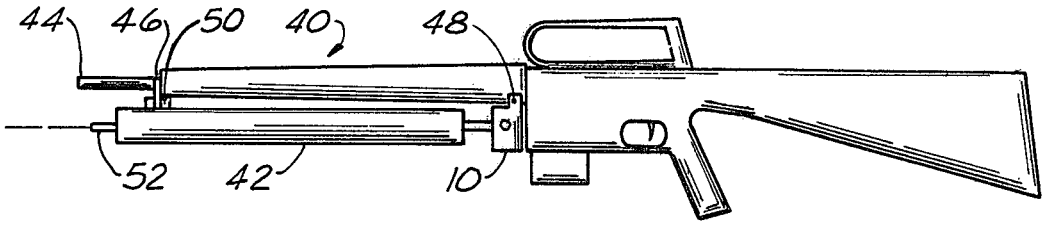
FIG. 3 is a side view of a laser aiming device having a windage and elevation mechanism attached thereto in accordance with the present invention.

To facilitate attachment of the windage and elevation element mechanism 10 to a firearm (not shown) flange elements 30 having apertures therein may be provided to bolt the mechanism 10 to the firearm, as shown in FIG. 3.

A retaining backplate 31 holds bearing 14 within the housing 22. Backplate 31 is affixed to housing 22 by screws through opertures 31*a*–31*c*.

Figure 2:
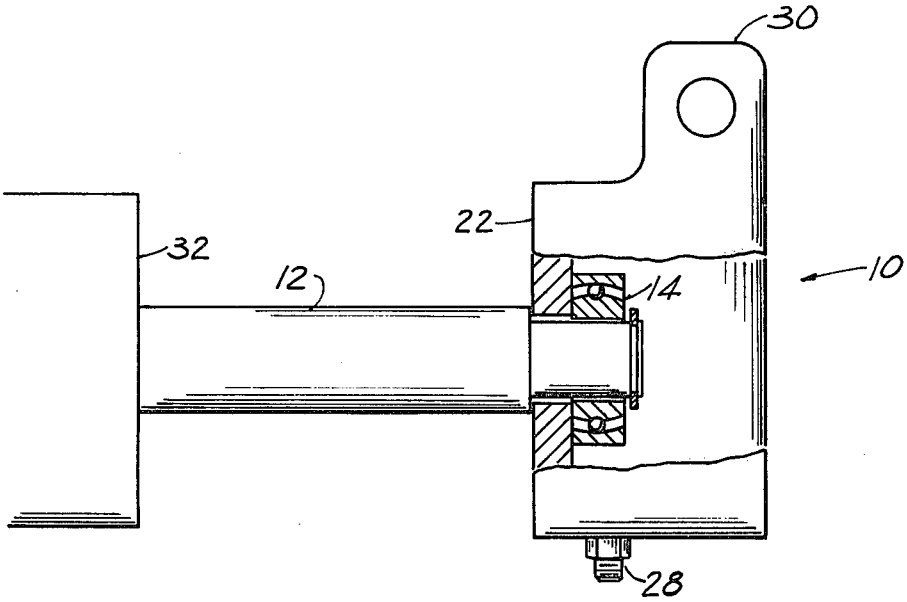
FIG. 2 is a partially sectioned side view of a windage and elevation mechanism in accordance with the present invention.

Referring now to FIG. 2 the windage and elevation element 10 is illustrated in a side view with a partial section illustrating the location of the bearing 14 within the housing 22. The axial shaft 12 is further shown connected to the bearing 14 and also to the laser carrying member 32.

Operationally, the windage and elevation mechanism illustrated in FIGS. 1 and 2 provides vertical and horizontal movement of the carrying member 32 by adjustment of the windage and elevation screws 26 and 28. When windage or horizontal movement of the laser carrying member 32 is desired, clockwise movement of the windage set screw 26 against the angle bracket 16 will operate upon bearing 14 so as to shift the axial shaft 12 in a horizontal direction thus horizontally moving the carrying member 32. A similar result is obtained by adjusting the elevation set screw 28, clockwise against angle bracket 16 to achieve vertical movement of the axial shaft 12 and thus vertical movement of the laser carrying member 32. Conversely, if horizontal or vertical movement is desired in the opposite direction, turning the Allen key set screws in a counterclockwise fashion releases pressure on the angle bracket 16. After pressure an angle bracket 16 is released the coil spring 20 exerts a force against spring cam 18, thus moving the bearing 14 to an initial position. This action simultaneously directs the axial shaft 12 and the laser carrying member 32 toward their initial positions.

FIG. 3 illustrates a firearm 40 having a laser aiming device 42 utilizing the windage and elevation mechanism 10 as described hereinabove. The firearm 40 has an elongate barrel 44 with the laser aiming device 42 attached thereto by a clamp 46. The laser device 42 is further connected to the firearm 40 by means of a bolt 48 through the flange 30 of the windage and elevation mechanism housing 22 as shown in FIGS. 1 and 2. A rubber mount 50 is located at the forward end of the laser device 42 so as to provide a pivot point for the windage and elevation adjustment mechanism 10. The rubber mount 50 prevents the laser aiming device 42 from rolling on the barrel 44 from side-to-side, and at the same time provides a pivot for horizontal and vertical adjustment of the carrying member 32. The laser aiming device 42 may be connected below the barrel 44 as shown in FIG. 3, may be above the barrel 44 or to either side of the barrel 44. Locating the laser device 42 beneath the barrel 44 provides the added feature of being able to utilize any optical sights the weapon 40 may have should the laser device 42 fail.

A shield 52 is attached to the laser aiming device 42 to hide the flash of the laser beam from a lateral observer. The shield 52 hides reflections from the optics and other reflective surfaces within the device 42.

While the invention has been described and illustrated with respect to a preferred embodiment it is apparent to those skilled in this art, that many modifications and changes in the apparatus may be made without departing from the scope and spirit of the invention as defined in the claims.

What is claimed is:

1. A windage and elevation mechanism for a weapon having an elongate barrel with a laser aiming device attached thereto comprising:

a support member;

a bearing disposed within said support member;

a shaft located between said bearing and said laser aiming device in axial alignment with said barrel, said shaft being rigidly attached to said laser aiming device and movably attached to said bearing; and adjusting means mounted to said support member operatively associated with said bearing for calibrating said laser aiming device in a vertical and horizontal direction.

2. A windage and elevation mechanism as set forth in claim 1, wherein said support member comprises a partially enclosed housing having a plurality of apertures therein for accepting said shaft and said adjusting means.

3. A windage and elevation mechanism as set forth in claim 2, wherein said support member further includes a first and second flange having apertures therein so as to enable attachment of said support member to said weapon.

4. A windage and elevation mechanism as set forth in claim 1, wherein said bearing comprises a swivel shaft bearing.

5. A windage and elevation mechanism as set forth in claim 1, further including an angle bracket disposed within said support member and operatively associated with said bearing and said adjusting means for moving said shaft when acted upon by said adjusting means.

6. A windage and elevation mechanism as set forth in claim 5, further including a spring cam and coil return spring disposed within said support member in opposed relationship to said angle bracket for moving said bearing in a direction toward said angle bracket upon readjustment of said adjusting means.

7. A windage and elevation mechanism as set forth in claim 5, wherein said angle bracket comprises a flat spring steel bearing.

8. A windage and elevation mechanism as set forth in claim 1, wherein said adjusting means comprises Allen key set screws.

9. An aiming system for a barreled weapon comprising:

a light source for generating a coherent beam of light;

a carrying member supporting said light source;

damping means for cushioning said light source from recoil forces resulting from the firing of said weapon; and a windage and elevation mechanism attached to the barrel of said weapon including:

a support member, a bearing disposed within said support member, a shaft disposed between said bearing and said carrying member in axial alignment with said barrel, said shaft movably attached to said bearing and rigidly attached to said carrying member; and adjusting means mounted to said support member operatively associated with said bearing for calibrating the windage and elevation of said light source.

10. A laser aiming system as set forth in claim 9, wherein said carrying member is a dustproof housing attached to said weapon.

11. A laser aiming system as set forth in claim 9, wherein said damping means comprises a buffer disposed between said light source and said housing.

12. A laser aiming system as set forth in claim 9, wherein said bearing comprises a swivel shaft bearing.

13. A laser aiming system as set forth in claim 9 wherein said adjustment means comprises Allen key set screws.

14. A laser aiming system as set forth in claim 9, further including a shield connected to said carrying member and operatively associated with said light source to hide light reflections.

15. An aiming system for a barreled weapon comprising:

a light source for generating a coherent beam of light;

a carrying member supporting said light source;

damping means for cushioning said light source from recoil forces resulting from the firing of said weapon; and a windage and elevation mechanism attached to said barrel of said weapon including:

a support member, a rod having one end substantially rigidly attached to said carrying member, and the other end movably attached to said support member so as to be in axial alignment with the barrel of said weapon, and means for supporting said rod within said support member; and adjusting means mounted to said support member operatively associated with said means for supporting said rod, for calibrating the windage and elevation of said light source.

16. A laser system as set forth in claim 15, further including a shield connected to said carrying member and operatively associated with said light source to hide light reflections.

17. A windage and elevation mechanism for a weapon having an elongate barrel with a laser aiming device attached thereto, comprising:

a support member;

a rod substantially rigidly attached to said laser aiming device and movably attached to said support member in axial alignment with said barrel of said weapon;

means for supporting said rod within said support member; and adjusting means mounted to said support member and operatively associated with said means for supporting said rod, for calibrating said laser aiming device in a vertical and horizontal direction.

* * * * *

UNITED STATES PATENT AND TRADEMARK OFFICE

CERTIFICATE OF CORRECTION

PATENT NO. 4,212,109

DATED July 15, 1980

INVENTOR(S) Wesley L. Snyder

It is certified that error appears in the above-identified patent and that said Letters Patent are hereby corrected as shown below:

Column 3, line 20, delete "opertures" and insert --apertures--.

Column 3, line 45, delete "an" and insert --on--.

Column 5, line 5, delete "ber;" and insert --ber,--.

Column 6, line 8, delete "and";

Column 6, line 10, delete "member; and" and insert --member, and--.

Signed and Sealed this

*Twenty-third* Day of *December 1980*

[SEAL]

*Attest:*

SIDNEY A. DIAMOND

*Attesting Officer*

*Commissioner of Patents and Trademarks*